US009796510B2

(12) United States Patent
Hagen

(10) Patent No.: US 9,796,510 B2
(45) Date of Patent: Oct. 24, 2017

(54) CONTAINER

(71) Applicant: RPC Bramlage GmbH, Lohne (DE)

(72) Inventor: Holger Hagen, Lohne (DE)

(73) Assignee: RPC Bramlage GmbH, Lohne (DE)

( * ) Notice: Subject to any disclaimer, the term of this patent is extended or adjusted under 35 U.S.C. 154(b) by 0 days.

(21) Appl. No.: 14/405,821

(22) PCT Filed: Jun. 4, 2013

(86) PCT No.: PCT/EP2013/061442

§ 371 (c)(1),
(2) Date: Dec. 5, 2014

(87) PCT Pub. No.: WO2013/182543

PCT Pub. Date: Dec. 12, 2013

(65) Prior Publication Data

US 2015/0298866 A1 Oct. 22, 2015

(30) Foreign Application Priority Data

Jun. 8, 2012 (DE) ..... 10 2012 104 966
Sep. 5, 2012 (DE) ..... 20 2012 103 382 U

(51) Int. Cl.
*B65D 41/04* (2006.01)
*B65D 41/34* (2006.01)
(Continued)

(52) U.S. Cl.
CPC ..... *B65D 41/04* (2013.01); *A45D 40/0068* (2013.01); *B65D 43/0225* (2013.01);
(Continued)

(58) Field of Classification Search
CPC .... B65D 41/04; B65D 41/0471; B65D 41/06; B65D 43/02; B65D 43/0231; B65D 41/34; B65D 47/122
(Continued)

(56) References Cited

U.S. PATENT DOCUMENTS 1,773,947 A 8/1930 Cadwallader
1,947,382 A 2/1934 Crowley
(Continued)

FOREIGN PATENT DOCUMENTS

BE 348 952 A 3/1928
DE 37 00 683 C1 1/1988
(Continued)

OTHER PUBLICATIONS

International Search Report of PCT/EP2013/061442, dated Sep. 3, 2013.

*Primary Examiner* — Andrew T Kirsch
(74) *Attorney, Agent, or Firm* — Collard & Roe, P.C.

(57) ABSTRACT

A container has a container lid and a container lower section connectible with each other via thread ribs on the lid and the lower section, by twisting the lid and the lower section relative to each other about a screwing axis of rotation. The thread ribs on the lid and the lower section extend over a circumferential angle of 90 degrees or less. A clearance at least equal to the circumferential extension thereof is left in the circumferential direction on the lid and the lower section. At least two thread ribs on the lid and the lower section overlap each other. A complete overrun circumferentially is possible in only one of the two opposing positions when an opposing position of a thread rib in the lower section or the lid is reached during a screwed connection in the direction of the screwing axis of rotation.

9 Claims, 4 Drawing Sheets

(51) Int. Cl.

| | |
|---|---|
| ***B65D 43/02*** | (2006.01) |
| ***B65D 41/06*** | (2006.01) |
| ***B65D 47/12*** | (2006.01) |
| ***A45D 40/00*** | (2006.01) |

(52) U.S. Cl.
CPC ..... *B65D 43/0231* (2013.01); *B65D 2543/00092* (2013.01); *B65D 2543/00296* (2013.01); *B65D 2543/00537* (2013.01); *B65D 2543/00583* (2013.01)

(58) Field of Classification Search
USPC ..... 215/329
See application file for complete search history.

(56) References Cited

U.S. PATENT DOCUMENTS

| | | | | |
|---|---|---|---|---|
| 3,510,021 | A * | 5/1970 | Silver | B65D 41/36 215/216 |
| 4,877,150 | A | 10/1989 | Otto et al. | |
| 5,449,078 | A * | 9/1995 | Akers | B65D 41/06 215/222 |
| 5,913,434 | A | 6/1999 | Fukuhara et al. | |
| 2006/0163252 | A1 | 7/2006 | Zalewski | |

FOREIGN PATENT DOCUMENTS

| | | | |
|---|---|---|---|
| EP | 1 097 874 | A1 | 5/2001 |
| JP | H06 81954 | U | 11/1994 |
| JP | H11 152155 | A | 6/1999 |

* cited by examiner

CONTAINER

CROSS REFERENCE TO RELATED APPLICATIONS

This application is the National Stage of PCT/EP2013/061442 filed on Jun. 4, 2013, which claims priority under 35 U.S.C. §119 of German Application Nos. 10 2012 104 966.1 filed on June 8, 2012 and 20 2012 103 382.8 filed on Sept. 5, 2012, the disclosures of which are incorporated by reference. The international application under PCT article 21 (2) was not published in English.

The invention relates to a container having a container lid and a container lower section, wherein the container lid and the container lower section are able to be connected to one another by means of screw configurations in the form of thread ribs on the container lid and the container lower section, if the lid and the lower section are rotated relative to one another about a screwing axis of rotation.

Containers of such kind are already known in many different applications. For example, as cosmetic jars, in which a cosmetic substance is accommodated. A user normally holds the container lower section in his or her hand and either twists the container lid off or unscrews it.

There is a need to construct such a container with a closure that can be operated more practically. In this context, the object on which the invention is based was to describe a container having an improved closure.

One possible solution to the object is realised according to a first inventive idea for a container in which thread ribs formed on both the container lid and the container lower section are formed over a circumferential angle of 90° or less, which thread ribs leave a gap at least equal to their circumferential extension in the circumferential direction on the respective part, the lid or the lower section, and at least two thread ribs are conformed in opposing positions in the lid and in the lower section, wherein additionally a complete overrun in the circumferential direction is possible in only one of the two opposing positions when an opposing position of a thread rib in the lid or the lower section and a corresponding thread rib in the lower section or the lid is reached in the course of a screwed connection in the direction of the screwing axis of rotation.

With this arrangement, it becomes possible to twist the container lid and the container lower section only slightly towards one another as far as the last closure thereof when the parts are moved into a position in which the corresponding gaps in the circumferential direction of the thread ribs are opposite one another and offset without a gap in the direction of the screwing axis of rotation. After such a (minimal) vertical movement of the container lower section and the container lid to a position of mutual contact, the parts only have to be moved in the circumferential direction relative to each other, that is to say it is no longer necessary for the parts (then) to be moved toward each other in the direction of the screwing axis of rotation as well, as is necessary in a usual screwing closure movement. In this context, a defined position may be reached in the screwed state between the container lid and the container lower section, since the screwed connection is only created in one of the two opposing positions, that is to say at a position with a defined circumferential position. In the other of the two cooperating positions in the circumferential direction, screwing results in overrun.

The thread ribs of the lids and the lower section are advantageously located with such a vertical separation that, when in the circumferential angular alignment in which the screwing end position has not been reached, they are separated from one another with respect to a circumferential strip that each occupies in the circumferential direction of the extension thereof in the direction of the screwing axis of rotation with allowance for a gradient. However, a certain elevation may be caused by placing or moving onto a thread rib when the parts are twisted toward one another, if, when viewed in such a circumferential angle the parts are (initially) brought into an overlapping position from the last closure position and then the rotating movement must be performed to reach the closure position, so that the thread ribs of the container lid and the container lower section are thus still in the overlapping position or possibly even reach such a position during the rotating movement.

Another possible solution for the object is also provided with a container in which the thread ribs conformed on both the container lid and the container lower section are conformed over a circumferential angle of 20° or less, only two thread ribs are conformed on the container lid and the container lower section, and the thread ribs of the container lid and the container lower section as individually set apart in the direction of the screwing axis of rotation, and do not overlap one another in this direction either.

Since there are only two thread ribs each conformed on the container lid and the container lower section, and these are also separated circumferentially in such manner that they extend without overlapping each other, and extend over a circumferential angle of less than 90°, a fastening connection can be created between the container lid and the container lower section very quickly by twisting. Moreover, such a container has a favourable appearance in the open position, particularly if the container is used for cosmetics, since the only two thread ribs in each case, particularly the thread ribs of the container lower section, which are most immediately noticeable in the open condition, create a rather non-technological impression. They may even be perceived as decorative ribs.

Additional features of the invention are described and illustrated in the following, in the description of the figures and in the drawing itself, often in a preferred association thereof with the concept outlined in the preceding, but they may also be significant in an association with just one or more individual features presented here either graphically or in writing, or independently or in a different overall concept.

Thus, it is preferred that a stop segment extending in the direction of the screwing axis of rotation is assigned to each of the thread ribs. The stop segment may be conformed directly on the thread rib. It visibly extends essentially perpendicularly and at a shallow angle to the thread rib to which it is assigned, with allowance for the gradient of the thread. Thus, the direction in which the stop segment extends with reference to the screwing axis of rotation is also defined with respect to the shallow angle.

The stop segment may also be conformed with an interruption on the thread rib,—seen in the direction of the screwing axis of rotation. At all events, it is essential for the purposes of the invention that the stop segment for a floor of the container lower section, and also for an upper surface of the container lid is conformed so closely to the thread rib to which it is assigned in the direction of the screwing axis of rotation that the opposing thread rib of the container lid or the container lower section that protrudes in a circumferential direction is blocked thereby in the direction of protrusion when it comes to bear on the stop segment. The stop segments additionally enable very precise definition of an end position in the tightening screwed direction. It is substantially possible to define the same end position without a stop segment, for example by means of a wedge insertion between the respective thread rib and a region on the lower section or the lid that is aligned perpendicularly to the screwing axis of rotation, and is no longer a part of the thread, or by clamping with the aid of an insertion limit stop, possibly formed by a lower frontal face of a circumferential wall of one part, which then comes to bear on a corresponding ridge in the other part, but it is not possible to define an end position with the same degree of precision as can be assured with the stop segment described above.

In a further particular, the container lid comprises a first circumferential wall extending in the direction of the screwing axis of rotation, and an upper surface extending perpendicularly thereto, or a limiting segment, which may also consist in a rib, optionally extending over only part of the circumference, that only protrudes radially inwardly or radially outwardly, or a shoulder serving the same function, wherein the thread ribs are formed on an inner side of the first circumferential wall, and wherein at one of the thread ribs in each case is also assigned to a free front border edge of the first circumferential wall farthest from the upper surface, whereas the other thread rib in each case is assigned to the upper surface. The thread ribs of the respective part of the container lid or the container lower section are preferably formed with a much distance between them as possible in the direction of the screwing axis of rotation. The actual dimension of separation also depends on the degree to which the first circumferential wall and the second circumferential wall, which will be described in the following, overlap each other in the direction of the screwing axis of rotation in the closed position. At all events, it is preferred that the distance between the thread ribs on the same part is greater in the direction of the screwing axis of rotation than a width of a thread rib in the same direction.

Also preferably, a second circumferential wall is conformed on the container lower section and extends in the direction of the screwing axis of rotation, and a container bottom is conformed perpendicularly thereto, wherein the thread ribs of the container lower section are conformed on an outer side of the second circumferential wall, and wherein one of the thread ribs of the container lower section is also assigned to a free front border edge of the second circumferential wall farthest from the bottom, while at least one further thread ribs of the container lower section is conformed on the bottom of the second circumferential wall.

The association described means in particular that a small vertical clearance exists between the thread rib and the assigned lid or free front border edge. This vertical clearance is preferably present in the range of a thickness of a thread winding. It is particularly preferred that the clearance is equal to the thickness of a thread winding in each case. It may also be larger, for example 1.1 to 2 times as large, or more, up to as much as three times the thickness of a thread winding.

The variant with the first and second circumferential walls described here means that in the screwing assignment the first circumferential wall is outer-most and the second circumferential wall is innermost. The opposite arrangement is also possible, to the effect that in the screwing assignment the first circumferential wall is innermost and the second circumferential wall is outer-most. In this case, the thread ribs on the container lid are visible on the outside of the first circumferential wall, and the thread ribs on the container lower section are formed on the inside of the second circumferential wall.

With regard to the first or circumferential wall, a circular cross section is also provided to enable the screwed connection to be completed. On the other hand, with regard to the container bottom and the container upper surface, this is not necessary to have a circular outline, although this is preferable. Rather, the preferably possible unique circumferential angular alignment relative to the circumferential walls that overlap one another to create the screwed connection also enables such a geometrical design of the container upper surface and/or the container bottom in respect of the outline thereof, which only results in a flush overlap in the closed position in this selected circumferential angular position relative to the circumferential walls.

Regarding the stop segments, it is preferred that one of the stop segments is conformed on the thread rib of the container list assigned to the container upper surface and/or that a stop segment or the additional stop segment is conformed on the thread rib provided on the bottom of the second circumferential wall of the container lower section.

The circumferential extension of said thread ribs is also preferably significantly less than 90°. The circumferential extension may be as small as e.g. 5 to 10°. Circumferential extension of a thread rib is preferably in the range from 30 to 70°.

Particularly given the preferably small circumferential angle configuration of a thread rib, a large circumferential area where no thread rib is present is evidently created on the first or second circumferential wall. On the other hand, in the closed state of the container, this may mean that the container lid, or a corresponding area of the circumferential wall of the container lid, can be pressed radially inwards by a certain dimension, and conversely that this may also occur if, as noted alternatively, the circumferential wall of the container lower section is on the outside in the closed state, and this circumferential wall of the container lower section is able to be pressed slightly radially inwards.

In order to remedy this, in a further preferred variant it is provided that a bracing segment protruding by the dimension of a thread winding is formed on the second circumferential wall in a circumferential interspace between the thread ribs. Correspondingly, said bracing segment might also be constructed to protrude radially inwardly from the first circumferential wall if said further design is realised by some means.

The bracing segment preferably does not protrude into the threaded connection, but it may fulfil a deflection function, for example.

The ranges and value ranges or multiple ranges specified in the preceding and hereafter, in this instance particularly with regard to the stated circumferential angles, also include all intermediate values, particularly as they relate to the stated circumferential angles for the purpose of the disclosure, particularly in increments of 1/10 of the respective dimension, and where applicable also without definition of a dimension, in this case particularly with regard to said circumferential angle, both in order to set lower and/or upper limits for said range boundaries, but also, alternatively or additionally, with a view to the disclosure of one or more singular values from an individually cited range.

The parameters of a part or an area that are discernible in the drawing may initially significant for the purposes of a size ratio with another illustrated part or area in the same figure or another figure, which part or area has been represented in the same change or the change in scale cited in respect thereof or in a definable change, in particular even if such a part or area is not otherwise described or cited in a claim. It may also be significant as an absolute parameter.

In detail, in the drawing:

FIG. 6 is a cross section through the container lid a first angularly rotated position;

FIG. 7 is a cross section according to FIG. 6 in second angularly rotated position offset by 180° with respect thereto;

Figure 2:
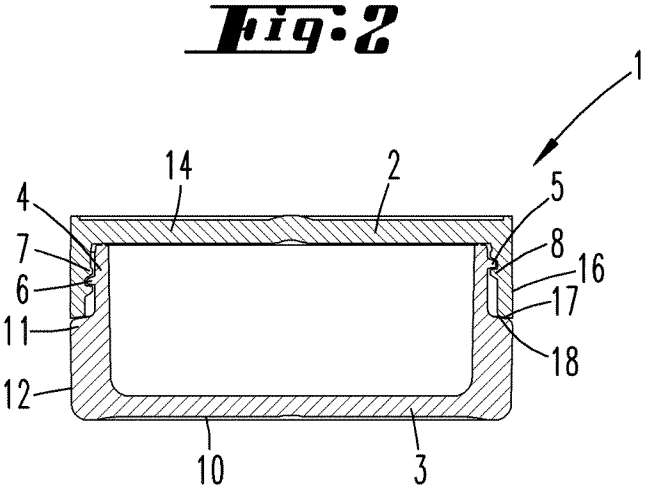
FIG. 2 is a cross section through the container of FIG. 1, along line II-II.

The drawing and description relate to a container 1 consisting of parts that are joined by a threaded connection, in particular a container lid 2 and container lower section 3.

The illustration is equivalent to a scale of 1:2, although it may also be understood to be equivalent to a scale of 1:1.

Figure 3:
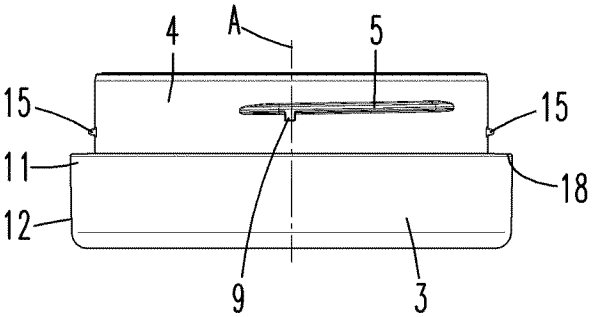
FIG. 3 is a side view of the container lower section in a first angularly rotated position.

As is also shown in FIG. 3, container lower section 3 comprises a second circumferential wall 4, which is conformed in such manner as to produce the screwed connection with two thread ribs 5 and 6, which are separated circumferentially from one another. As may be seen in FIG. 10, for example, thread ribs 6 and 5 extend over a circumferential angle $\alpha$ of about 50°. Circumferential angle $\alpha$ is measured from a central screwing axis of rotation A of container lower section 3, which is otherwise preferably constructed to be rotationally symmetrical. Container lid 2 is preferably also constructed to be rotationally symmetrical. Of course, this rotational symmetry is calculated without consideration for the thread ribs, and where applicable also excluding bracing segment 15, which is described later, and/or any design-related particularities. One design-related particularity may be provided as rotationally non-symmetrical from the technical aspect that, as explained, and preferred in any case, the same circumferential angular assignment of the container lower section to the container lid is always assured in the closed state. Thus, the container lid may have, for example, a radially shaped but vertically extending rib on a singular circumferential region that always overlaps a rib of the container lower section that is radially shaped in the same direction in the closed state.

Figure 9:
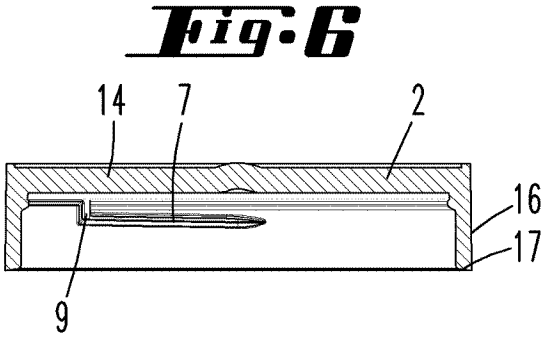
FIG. 9 is representation corresponding to that of FIG. 8 of the angularly rotate position of the container lid of FIG. 7.
Figure 8:
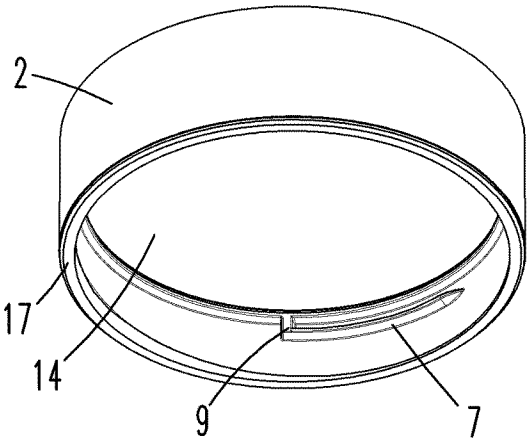
FIG. 8 is a perspective view from below of the container lid of FIG. 6.
Figure 5:
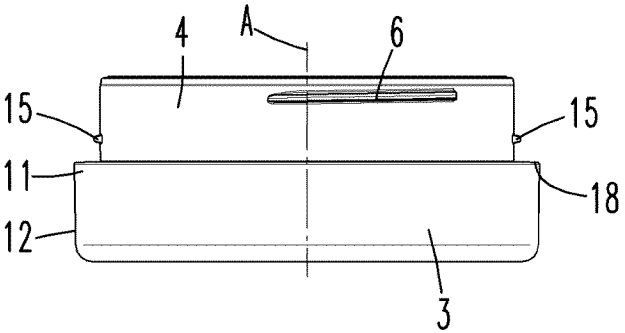
FIG. 5 is a further representation according to FIG. 3 and FIG. 4, wherein the angularly rotated position of the view in FIG. 5 is offset by 180° relative to that of FIG. 3.
Figure 4:
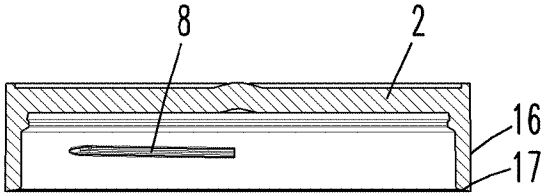
Figure 9:
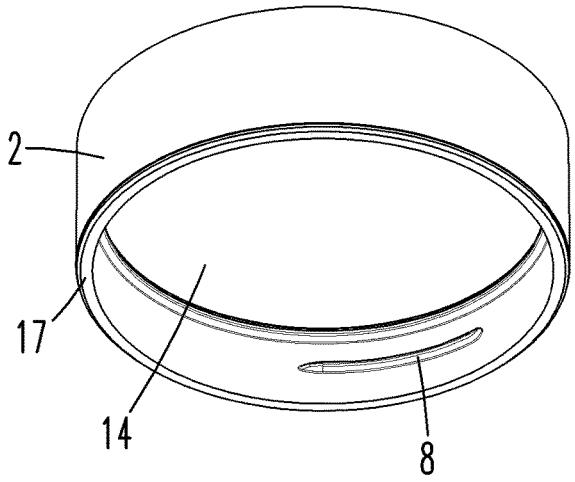

In the same way as on container lid 2, on container lower section 3 only the thread ribs 5, 6 described specifically in the preceding, or, with regard to container lid 2, thread ribs 7 and 8 are conformed on container lower section 3 (see FIGS. 8 and 9).

Figure 10:
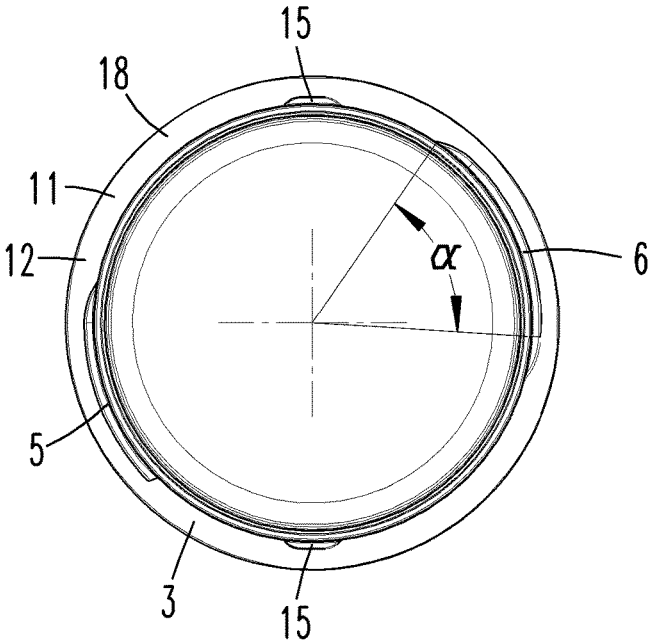
FIG. 10 is a top view of the side of the container lower section with the opening; und
Figure 11:
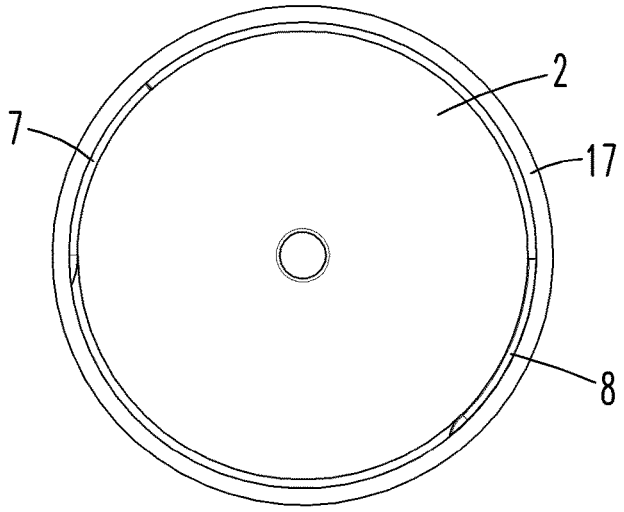
FIG. 11 is a top view of the side of the container lid with the opening.

As is shown clearly in FIG. 10 and FIG. 11 thread ribs 5, 6 and 7, 8 evidently do not overlap in the direction of screwing axis of rotation A, and are conformed so as to be practically opposite each other. Moreover, a circumferential space corresponding to a circumferential angle $\beta$ is produced between thread ribs 5, 6 and 7, 8 respectively, as is also shown in FIGS. 10 and 11, which circumferential angle is significantly larger than circumferential angle $\alpha$, and in the embodiment and preferably is equivalent to more than twice the size of circumferential angle $\alpha$.

Between the thread ribs 5, 6 and 7, 8 respectively that are formed only on container lid 2 and container lower section 3 and located opposite each other, angle $\beta$ is created visibly as half of 360° minus twice the value of angle $\alpha$.

In the following, container 1 is preferably considered to be an injection moulded plastic part, with separate plastic injection moulded parts in the form of container lid 2 and container lower section 3. For example, polypropylene or polyethylene are conceivable as the manufacturing material, or other suitably workable plastic materials that lend themselves to injection moulding processes.

A stop segment 9 extending in the direction of screwing axis of rotation A is constructed on one of thread ribs 5 or 6, in this case on container lower section 3 on thread winding 5, and in the case of container lid 2 the stop segment 9 is conformed on upper thread rib 7. In this context, the term "upper" means that stop segment 9 is created at the point farthest from bottom 10 of container 1 with reference to the screwing axis of rotation.

Stop segments 9 extend practically at right angle to the alignment of the respective thread rib 5 or 6. Relative to container lid 2 they extend toward the upper surface, and relative to container lower section 3 they extend toward the bottom.

Figure 1:
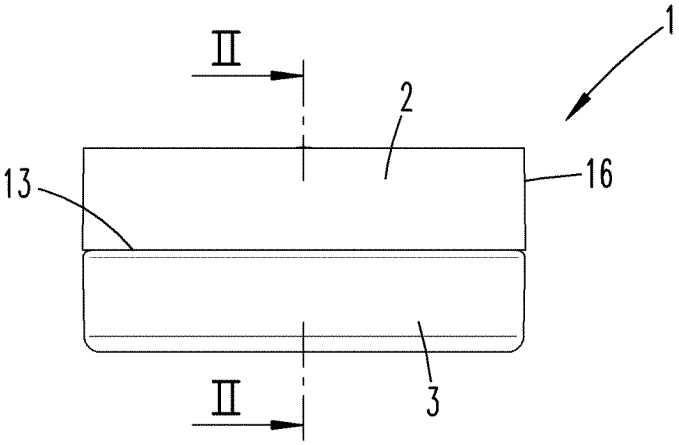
FIG. 1 is a side view of the container in the closed state.

The bottom of second circumferential wall 4 of container lower section 3 clearly extends radially outwardly over a shoulder 11 and becomes a circumferential bottom wall 12. In the screwed state as shown in FIG. 1, shoulder 11 provides visible separating line between container lid 2 and container lower section 3.

Regarding the stop segments 9 described earlier, it is preferred that thread rib 5 together with shoulder 11 forms an insertion opening that is limited in the direction of rotation and also laterally in both directions of screwing axis of rotation A for inserting thread rib 8 of container lid 2. The width of the insertion opening, that is to say the length thereof in the direction of screwing axis of rotation A, is preferably equal the width of an associated thread rib, or is only marginally larger.

A similar insertion opening is formed by thread rib 7 of container lid 2 in cooperation with the top of an upper surface 14 or optionally a shoulder thereof extending at right angles to screwing axis of rotation A. As it shown in the exemplary embodiment, a bracing segment 15 is conformed in an intermediate space between thread ribs 5 and 6 of container lower section 3, and preferably centrally to the circumference relative to said circumferential intermediate space. In this way, it is possible to prevent first circumferential wall 16 as shown in FIG. 2 from being pressed inwards in the closed state. Otherwise, bracing segment 15 does not engage in the mechanism whereby the parts are locked together. It may be conformed in the same way as a thread rib with a gradient, but it may also extend at right angles to screwing axis of rotation A.

Figure 4:
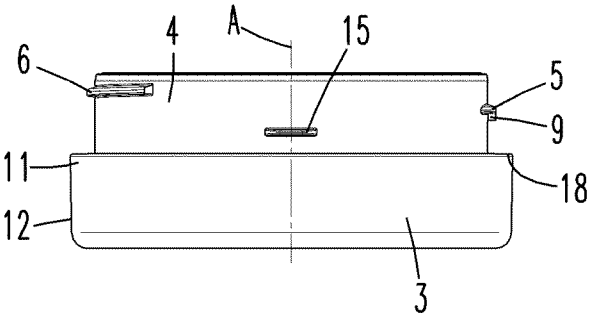
FIG. 4 is a representation according to FIG. 3, in a second angularly rotated position, offset from the first angularly rotated position by 90°.

When container lid 2 and container lower section 3, are placed together for the purpose of closing them, it may already be possible in one circumferentially angular position of the parts relative to one another for thread rib 8 of container lid 2 to protrude into the circumferential intermediate space between thread rib 5 and thread rib 6 of container lower section 3, as would correspond to the position shown in FIG. 4. All that is required then is approximately a quarter turn of the parts relative to each other so that the frontal surface associated with thread rib 6 in FIG. 4 and facing in the circumferential direction comes to rest against stop segment 9, which is conformed in assignment to thread rib 7 of container lid 2. At the same time, thread rib 8 then moves against stop segment 9 of lower thread rib 5 of container lower section 3.

However, it may also be that such a circumferential offset is produced in the vertical joining of container lower section 2 and container lid 3, that thread rib 8 of container lid 2 is in an overlapping position relative to thread rib 5 of container lower section 3. Depending on the specific design, this may result in a certain tendency to rise, and as movement continues in the screwing direction, thread windings 5 and 8 separate and a frontal face 17 of circumferential wall 16 may come to bear against the assigned surface 18 of shoulder 11, thereby determining the vertical attachment of container lower section 3 and container lid 2 for the subsequent closing operation.

Moreover, a circumferential direction may also be provided, such that when the parts are approached vertically in the screwed closure direction, thread rib 8 of container lid 2 is located circumferentially in front of thread rib 5 of container lower section 3. In such a case, the vertical contact of said surfaces 17 and 18 is also assured. The design may then be adapted in such manner that either the vertical separation of thread ribs 5 and 8 is such that they move past each other without contact, or that thread rib 8 is raised a certain distance by thread rib 5 which action however prevents thread rib 8 from passing below thread rib 5. If this elevation were to take place, surfaces 17 and 18 would also be positioned at a small distance from each other for this region of the circumferential angle.

The gradient of a thread rib 5, 6 or 7, 8 respectively is in the range from 2° to 4°, more preferably 3°.

All of the features disclosed (individually) essential to the invention. The contents of the disclosure of the associated/accompanying priority documents (transcript of the preliminary application) are herewith incorporated in their totality in the disclosure of the present application, also for the purpose of including features of said documents in the claims of the present application. In their optionally coordinate version, the subordinate claims characterise inventive advances on the prior art that are capable of consideration on their own merits, particularly with a view to submitting divisional applications based on these claims.

LIST OF REFERENCE SIGNS

1 Container
2 Container lid
3 Container lower section
4 Second circumferential wall
5 Thread rib
6 Thread rib
7 Thread rib
8 Thread rib
9 Stop segment
10 Bottom
11 Shoulder
12 Bottom circumferential wall
13 Separating line
14 Upper surface
15 Bracing segment
16 First circumferential wall
17 Frontal face
18 Surface
A Screwing axis of rotation
α Circumferential angle
β Circumferential angle

The invention claimed is:

1. A container with a container lid and a container lower section, wherein the container lid and the container lower section are connectible with each other via thread ribs on the container lid and on the container lower section, by twisting the lid and the lower section relative to each other about a screwing axis of rotation, wherein only two thread ribs are formed on each of the container lid and the container lower section, wherein the thread ribs formed on each of the container lid and on the container lower section have a circumferential extension extending over a circumferential angle between 30 and 70 degrees, wherein each thread rib has a pitch between 2 and 4 degrees, wherein a clearance at least equal to the circumferential extension is left between two adjacent thread ribs on both the lid and the lower section in the circumferential direction on the lid and on the lower section, and at least two of the thread ribs are constructed on the lid and the lower section in opposed positions to each other, wherein a complete overrun in the circumferential direction is possible in only one of two opposing positions of the two thread ribs when an opposing position of a thread rib in the lower section or the lid is reached in the course of a screwed connection in the direction of the screwing axis of rotation, wherein the container lower section comprises a shoulder and the container lid comprises a lower edge, and wherein in a closed position of the container the lower edge of the container lid lies directly on the shoulder of the container lower section.

2. The container according to claim 1, wherein the thread ribs of the container lid and the container lower section are positioned at a distance from each other in the direction of the screwing axis of rotation, and wherein they are also not aligned to overlap each other in this direction.

3. The container according to claim 1, wherein a stop segment extending in the direction of screwing axis of rotation is attached to one of each of the thread ribs on the lid or the lower section.

4. The container according to claim 1, wherein the container lid comprises a first circumferential wall extending in the direction of screwing axis of rotation and a container upper surface extending perpendicularly thereto, wherein the thread ribs are formed on an inner side of the first circumferential wall, and wherein one of the thread ribs is attached to a free front border edge of the first circumferential wall facing away from the upper surface, while the other thread rib is attached to the upper surface of the container.

5. The container according to claim 1, wherein the container lower section comprises a second circumferential wall extending in the direction of the screwing axis of rotation, and a container bottom extending perpendicularly thereto, wherein the thread ribs formed on the container lower section are formed on an outer side of the second circumferential wall, and wherein one of the thread ribs is attached to a free front border edge of the second circumferential wall facing away from the bottom surface, while the other thread rib is formed on a bottom portion of the second circumferential wall so that the ribs formed on the container lower section differ from each other in a vertical direction.

6. The container according to claim 3, wherein one of the stop segments is formed on the thread rib of the container lid that is attached to the upper surface of the container.

7. The container according to claim 3, wherein one of the stop segments is formed on the thread rib provided on the bottom of the second circumferential wall of the container lower section.

8. The container according to claim 1, wherein a bracing segment that protrudes radially by the dimension of a thread rib is formed in a circumferential intermediate space between the thread ribs.

9. The container according to claim 1, wherein the thread ribs on the container lid are a first thread rib and a second thread rib, wherein the first thread rib is disposed vertically higher than the second thread rib.

* * * * *